United States Patent [19]

Iizuka et al.

[11] 4,296,724

[45] Oct. 27, 1981

[54] INTERNAL COMBUSTION ENGINE

[75] Inventors: Haruhiko Iizuka, Yokosuka; Fukashi Sugasawa, Yokohama, both of Japan

[73] Assignee: Nissan Motor Company, Limited, Yokohama, Japan

[21] Appl. No.: 108,228

[22] Filed: Dec. 28, 1979

[30] Foreign Application Priority Data

Jan. 8, 1979 [JP] Japan ..... 54-1186

[51] Int. Cl.[3] ..... F02M 25/06

[52] U.S. Cl. ..... 123/568

[58] Field of Search ..... 123/568, 569, 571, 198 F

[56] References Cited

U.S. PATENT DOCUMENTS

| | | | |
|---|---|---|---|
| 3,963,379 | 6/1976 | Ueno | 123/198 F |
| 4,106,471 | 8/1978 | Nakajima et al. | 123/198 F |
| 4,184,470 | 1/1980 | Iizuka | 123/198 F |
| 4,192,278 | 3/1980 | Iizuka et al. | 123/198 F |
| 4,198,940 | 4/1980 | Ishida | 123/568 |
| 4,201,180 | 5/1980 | Iizuka | 123/568 |
| 4,231,338 | 11/1980 | Sugasawa | 123/568 |
| 4,249,374 | 2/1981 | Sugasawa | 123/568 |

*Primary Examiner*—Wendell E. Burns

*Attorney, Agent, or Firm*—Schwartz, Jeffery, Schwaab, Mack, Blumenthal & Koch

[57] ABSTRACT

An internal combustion engine is disclosed which includes a plurality of cylinders split into first and second groups and operates in a split cylinder mode under low engine load conditions where the second group of cylinders are held inoperative and have their intake and exhaust ports connected to each other. Means is provided for preventing exhaust gases discharged from the second group of cylinders from mixing with exhaust gases discharged from the first group of cylinders during the split cylinder mode of operation.

8 Claims, 3 Drawing Figures

INTERNAL COMBUSTION ENGINE

BACKGROUND OF THE INVENTION

1. Field of the Invention

This invention relates to improvments in a split type internal combustion engine including a plurality of cylinders split into two groups and operating in a split cylinder mode under engine low load conditions where one group of cylinders are supplied with fuel and fresh air and held operative and the other group of cylinders are supplied with neither fuel nor fresh air and held suspended.

2. Description of the Prior Art

It is generally known that internal combustion engines exhibit higher fuel combustion and thus higher fuel economy when running under higher load conditions. In view of this fact, split type internal combustion engines have already been proposed as automotive vehicle engines or the like subject to frequent engine load variations. Such split type internal combustion engines comprises a plurality of cylinders split into first and second groups, an intake passage provided therein with a throttle valve and being divided downstream of the throttle valve into a first branch leading to the first group of cylinders and a second branch leading to the second group of cylinders, an air stop valve provided at the entrance of the second branch for opening and closing the second branch, and control means responsive to engine low load conditions for closing the air stop valve to prevent fresh air from flowing into the second group of cylinders and for cutting off the supply of fuel into the second group of cylinders so as to place the engine in its split cylinder mode of operation. As a result, the other operative cylinders can operate with high loads, which results in high fuel economy.

Additionally, exhaust gases are re-introduced into the second branch to suppress pumping loss in the second group of cylinders during a split cylinder mode of operation. This attains further high fuel economy.

One difficulty with such conventional split type internal combustion engines is that during a split cylinder mode of operation, air discharged from the suspended cylinders is mixed with gases exhausted from the operating cylinders and discharged through its exhaust system. This causes a reduction of the temperature of exhaust gases passing through a three-way catalyzer provided in the exhaust system to spoil its exhaust emission purifying performance and also a reduction of the accuracy of the air-fuel ratio feedback control made by an oxygen sensor provided in the exhaust system.

SUMMARY OF THE INVENTION

It is therefore one object of the present invention to eliminate the above described disadvantages found in conventional split type internal combustion engine.

Another object of the present invention is to provide an improved split type internal combustion engine which is conducive to optimum catalyzer performance.

Still another object of the present invention is to provide an improved split type internal combustion engine which is conducive to high air-fuel ratio feedback control accuracy.

Other objects, features, and advantages of the present invention will become apparent to one skilled in the art thereof from the following description.

DESCRIPTION OF THE PREFERRED EMBODIMENT

Figure 1:
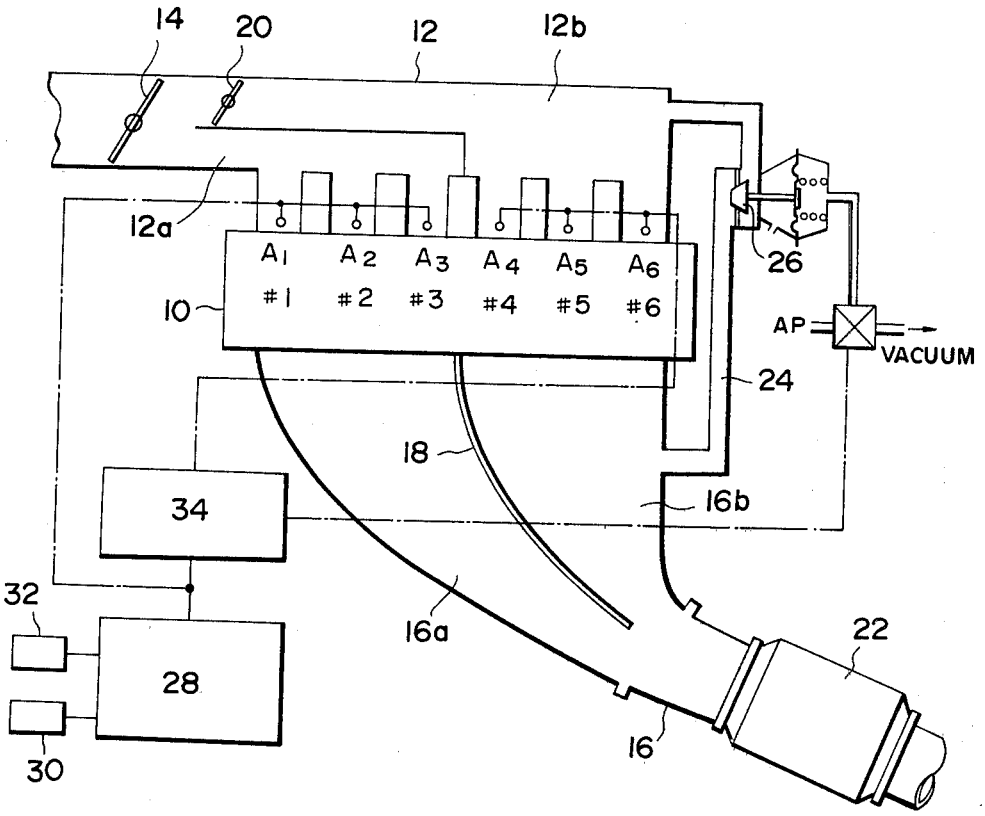
FIG. 1 is a schematic sectional view showing a conventional split type internal combustion engine.

Prior to the description of the preferred embodiment of the present invention, we shall briefly describe the prior art split type internal combustion engine in FIG. 1 in order to specifically point out the difficulties attendant thereto.

Referring to FIG. 1, the conventional split type internal combustion engine includes an engine body 10 having a plurality of cylinders split into first and second groups, an intake passage 12 provided therein with a throttle valve 14 and being divided downstream of the throttle valve 14 into first and second branches 12*a* and 12*b*, the first branch 12*a* leading to the first group of cylinders #1 to #3, and the second branch 12*b* leading to the second group of cylinders #4 to #6, an exhaust passage 16 having its upstream portion divided into first and second branches 16*a* and 16*b* by a partition 18, the first branch 16*a* leading to the first group of cylinders #1 to #3, and the second branch 16*b* leading to the second group of cylinders #4 to #6. An air stop valve 20 is provided at the entrance of the second branch 12*b* of the intake passage 12 for opening and closing the second branch 12*b*. Provided in the exhaust passage 16 downstream of the trailing end of the partition 18 is a catalyzer 22 such as a three-way catalyzer for purifying exhaust emissions. An exhaust gas re-introduction (EGR) passage 24 opens at its one end into the second branch 12*b* of the intake passage 12 and at the other end into the second branch 16*b* of the exhaust passage 16. An EGR valve 26 is provided in the EGR passage 24 for opening and closing it.

The engine also includes a fuel injection control circuit 28 which has inputs from an intake airflow sensor 30 and an engine speed sensor 32 for providing, in synchronism with rotation of the engine, a fuel injection pulse signal of pulse width dependent upon the amount of air introduced to the engine. The fuel injection pulse signal is applied directly to a first group of fuel injection valves A1 to A3 for supplying fuel into the respective cylinders #1 to #3 and also to a load detector circuit 34. The load detector circuit 34 is responsive to engine load conditions for connecting the output of the fuel injection control circuit 28 to a second group of fuel injection valves A4 to A6 for supplying fuel into the respective cylinders #4 to #6 under high load conditions and for disconnecting the output of the fuel injection control circuit 28 from the second group of fuel injection valves #4 to #6 under low load conditions. The load detector circuit 34 also provides a first control signal to cause the air stop valve 20 to open and the EGR valve 26 to close under high load conditions and provides a second control signal to cause the air stop valve 20 to close and the EGR valve 26 to open under low load conditions.

When the engine is under low load conditions, the load detector circuit 34 shuts off the fuel injection pulse signal from the fuel injection control circuit 28 to the second group of fuel injection valves A4 to A6 to stop the supply of fuel into the second group of cylinders. In addition, the load detector circuit 34 provides a second control signal to cause the air stop valve 20 to close so as to stop the supply of fresh air into the second group of cylinders. Accordingly, the engine is in a split cylinder mode of operation where the first group of cylinders #1 to #3 are held operative and the second group of cylinders #4 to #6 are held inoperative. The EGR valve 26 is responsive to the second control signal from the load detector circuit 34 to open the EGR passage 24 so as to allow re-introduction of exhaust gases from the second branch 16*b* of the exhaust passage 16 into the second branch 12*b* of the intake passage 12 thereby supressing pumping loss in the second group of cylinders #4 to #6.

When the engine is under high load conditions, the load detector circuit 34 allows the passage of the fuel injection pulse signal from the fuel injection control circuit 28 to the second group of fuel injection valves A4 to A6 which are thereby operated. Additionally, the load detector circuit 34 provides a first control signal to cause the air stop valve 20 to open so as to allow fresh air to flow into the second group of cylinders #4 to #6. Accordingly, the engine is in a full cylinder mode of operation where all of the cylinders #1 to #6 are held operative. In this case, the EGR valve 26 is responsive to the first control signal from the load detector circuit 34 to close the EGR passage 24 so as to block the flow of exhaust gases into the second branch 12*b* of the intake passage 12 thereby preventing fuel combustion aggravation.

The load detector circuit 34 may be of the type detecting engine load conditions in response to the pulse width of fuel injection pulse signals from the fuel injection control circuit 28 or the degree of opening of the throttle valve 14.

Such conventional split type internal combustion engines are disadvantageous in that during a split cylinder mode of operation, the exhaust gases discharged from the second group of cylinders #4 to #6 are gradually cooled during recirculation thereof and mixed with the exhaust gases discharged from the first group of cylinders #1 to #3. This causes a reduction of the temperature of exhaust gases passing through the three-way catalyzer 22 to spoil its exhaust emission purifying performance and also a reduction of the accuracy of air-fuel ratio feedback control.

Figure 2:
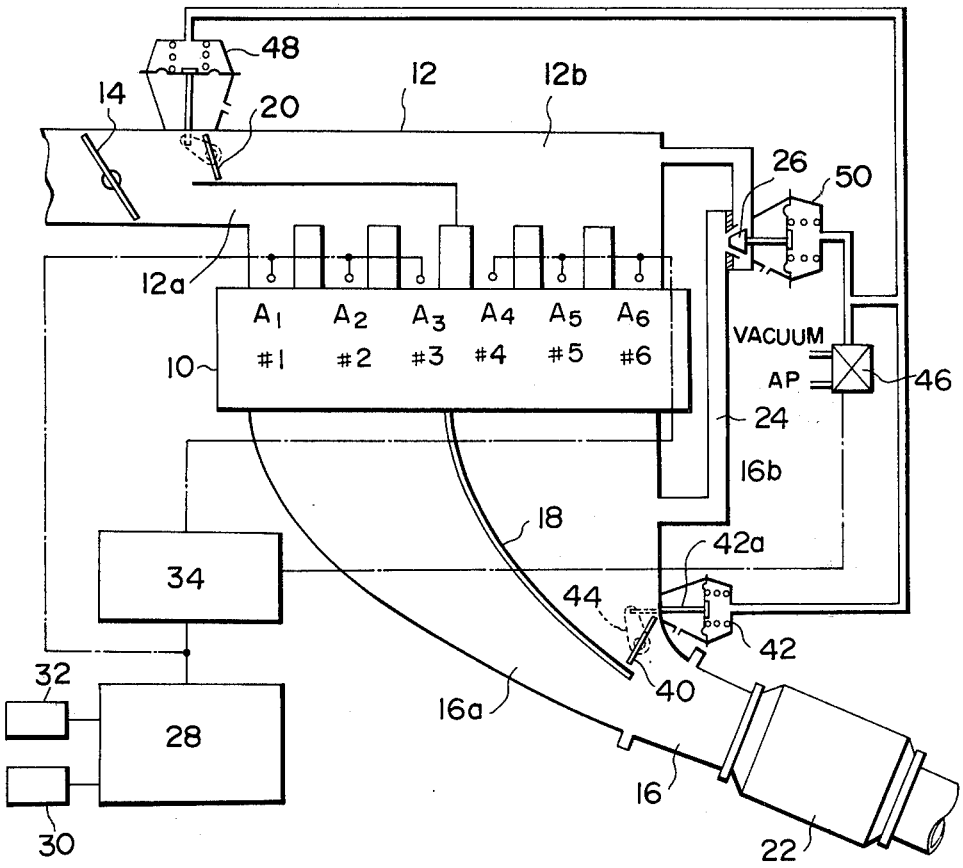
FIG. 2 is a schematic sectional view showing one embodiment of a split type internal combustion engine made in accordance with the present invention.

Referring to FIG. 2, there is illustrated one embodiment of a split type internal combustion engine made in accordance with the present invention. Parts in FIG. 2 which are like those in FIG. 1 have been given the same reference character.

Figure 3:
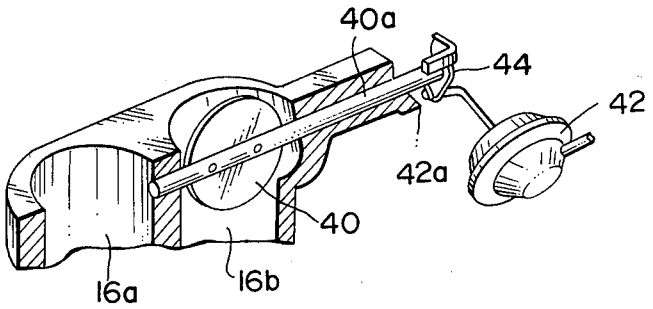
FIG. 3 is an fragmentary enlarged perspective view, partly in section showing the exhaust gas stop valve used in the engine of FIG. 2.

The engine of the present invention comprises an exhaust gas stop valve 40 provided in the second branch 16*b* of the exhaust passage 16 downstream of the opening of the EGR passage 24 but upstream of the trailing end of the partition 18 for opening and closing the second branch 16*b*. The exhaust gas stop valve 40 is operated by a diaphragm unit 42 which comprises a diaphragm spread within a casing to form a working chamber, an operation rod 42*a* having its one end fixed on the diaphragm and the other end drivingly connected to the exhaust gas stop valve 40, and a balance spring provided within the working chamber for urging the diaphragm in a direction to cause the exhaust gas stop valve 40 to open. In more detail, the operating rod 42*a* of the diaphragm unit 42 is connected through a lever 44 to the support shaft 40*a* of the exhaust gas stop valve 40 as shown in FIG. 3.

The working chamber of the diaphragm unit 42 is connected to the first opening of a three-way solenoid valve 46 which has a third opening connected to a vacuum source and a second opening connected to atmospheric pressure. The solenoid valve 46 is responsive to the first signal from the load detector circuit 34 for connecting its first and second openings so as to conduct atmospheric pressure to the working chamber of the diaphragm unit 42 thereby causing the exhaust gas stop valve 40 to open the second branch 16*b* and is responsive to the second signal therefrom for connecting its first and third openings so as to conduct vacuum to the working chamber of the diaphragm unit 42 thereby causing the exhaust gas stop valve 40 to close the second branch 16*b*.

The air stop valve 20 is operated by a diaphragm unit 48 which comprises a diaphragm spread within a casing to form a working chamber connected to the first opening of the three-way soleniod valve 46, an operation rod drivingly connecting the diaphragm to the air stop valve 20, and a balance spring provided within the working chamber for urging the diaphragm in a direction to cause the air stop valve 20 to open. Thus, the working chamber is supplied with atmospheric pressure to cause the air stop valve 20 to open and the second branch 12*b* of the intake passage 12 under high load conditions and with vacuum to cause the air stop valve 20 to close the second branch 12*b* thereof under low load conditions.

The EGR valve 26 is operated by a diaphragm unit 50 which comprises a diaphragm spread within a casing to form a working chamber connected to the first opening of the three-way solenoid valve 46, an operating rod drivingly connecting the diaphragm to the EGR valve 26, and a balance spring provided within the working chamber for urging the diaphragm in a direction to cause the EGR valve 26 to close. Thus, the working chamber is supplied with atmospheric pressure to cause the EGR valve 26 to close the EGR passage 24 under high load conditions and with vacuum to cause the EGR valve 26 to open the EGR passage 24 under low load conditions.

In operation, when the engine is under high load conditions, the load detector circuit 34 allows the passage of a fuel injection pulse signal from the fuel injection control circuit 28 to the second group of fuel injection valves A4 to A6 so that fuel is supplied into all of the cylinders #1 to #6. The load detector circuit 34 also provides a first control signal to the three-way solenoid valve 46 which thereby makes a connection between its first and second openings to conduct atmospheric pressure to the working chambers of the diaphragm units 42, 48 and 50. This causes the air stop valve 20 to open as to allow fresh air to flow into the second group of cylinders #4 to #6. Thus, the engine is in a full cylinder mode of operation and the exhaust gases discharged from the second group of cylinders #4 to #6 pass the exhaust passage 16 toward the catalyzer 22. Under these conditions, the EGR valve 26 is closed to stop re-introduction of exhaust gases from the second branch 16*b* of the exhaust passage 16 into the second branch 12*b* of the intake passage 12 and the exhaust gas stop valve 40 is open to allow the flow of exhaust gases discharged from the second group of cylinders #4 to #6 toward the catalyzer 22.

When the engine is shifted from its full cylinder mode to its split cylinder mode, the load detector circuit 34 blocks the fuel injection pulse signal to the second group of fuel injection valves A4 to A6 and holds them inoperative. The load detector circuit 34 also provides a second control signal to the three-way solenoid valve 46 to make a connection between the first and third openings of the solenoid valve 46 so as to conduct vacuum to the working chambers of the diaphragm units 42, 48 and 50. This causes the air stop valve 20 to close so as to stop the flow of fresh air to the second group of cylinders #4 to #6. Thus, the engine is in a split cylinder mode of operation. Under this condition, the EGR valve 26 is open to allow exhaust gases to flow into the second branch 12*b* of the intake passage 12 so as to suppress pumping loss in the second group of cylinders #4 to #6 which are suspended and the exhaust gas stop valve 40 is closed to prevent the flow of exhaust gases discharged from the second group of cylinders #4 to #6 toward the catalyzer 22. Accordingly, the temperature of exhaust gases passing the catalyzer 22 can be held at a high level conducive to catalyzer maximum performance and no difference occurs in oxygen concentration between the burned mixture and exhaust gases passing over an oxygen sensor provided in the exhaust passage, resulting in accurate air-fuel ratio feedback control.

Although the air stop valve 20, EGR valve 26, and exhaust gas stop valve 40 have been described as operated by a vacuum operated system in the above embodiment, it is to be understood that each of these valves may be substituted with an electrically operated solenoid valve responsive to the output of the load detector circuit 34 for opening and closing.

There has been provided, in accordance with the present invention, an improved split type internal combustion engine which is conducive to optimum catalyzer performance and high air-fuel ratio feedback control accuracy. While the present invention has been described in conjunction with a specific embodiment thereof, it is evident that many alternatives, modifications and variations will be apparent to those skilled in the art. Accordingly, it is intended to embrace all alternatives, modifications and variations that fall within the spirit and broad scope of the appended claims.

What is claimed is:

1. An internal combustion engine comprising:

(a) a plurality of cylinders split into first and second groups;

(b) an intake passage provided therein with a throttle valve and being divided downstream of said throttle valve into first and second branches, said first branch communicating with said first group of cylinders, and said second branch communicating with said second group of cylinders;

(c) an exhaust passage having its upstream portion divided into first and second branches, said first branch communicating with said first group of cylinders, and said second branch communicating with said second group of cylinders;

(d) an EGR passage having its one end opening into said second branch of said exhaust passage and the other end opening into said second branch of said intake passage;

(e) control means for providing a first signal under high engine load conditions and a second signal under low engine load conditions;

(f) first valve means provided in said second branch of said exhaust passage downstream of the opening of said EGR passage, said first valve means being responsive to the first signal for opening said second branch of said exhaust passage and being responsive to the second signal for closing the same;

(g) second valve means provided in said second branch of said intake passage, said second valve means being responsive to the first signal for opening said second branch of said intake passage and being responsive to the second signal therefrom for closing the same; and (h) third valve means provided in said EGR passage, said third valve means being responsive to the first signal for closing said EGR passage and being responsive to the second signal for opening the same.

2. An internal combustion engine according to claim 1, wherein said first valve means comprises a solenoid valve responsive to the first signal for opening said second branch of said exhaust passage and responsive to the second signal for closing the same.

3. An internal combustion engine according to claim 1, wherein said first valve means comprises a valve member for opening and closing said second branch of said exhaust passage, a pressure operated valve actuator responsive to atmospheric pressure for causing said valve member to open said second branch of said exhaust passage and responsive to vacuum for causing said valve member to close the same, and a three-way solenoid valve having a first opening connected to said valve actuator, a second opening connected to atmospheric pressure, and a third opening connected to a vacuum source, said solenoid valve being responsive to the first signal for connecting its first opening to its second opening and being responsive to the second signal for connecting its first opening to its third opening.

4. An internal combustion engine according to claim 3, wherein said pressure operated valve actuator comprises a diaphragm spread within a casing to form a working chamber connected to said first opening of said three-way solenoid valve, an operating rod having its one end fixed on said diaphragm and the other end drivingly connected to said valve member, and a balance spring provided within said working chamber for urging said diaphragm in a direction to cause said valve member to open said second branch of said exhaust passage.

5. An internal combustion engine according to claim 3, wherein said second valve means comprises a second valve member for opening and closing said second branch of said intake passage, a second pressure operated valve actuator connected to said first opening of said three-way solenoid valve, and said second valve actuator being responsive to atmospheric pressure for causing said second valve member to open said second branch of said intake passage and being responsive to vacuum for causing said second valve member to close the same.

6. An internal combustion engine according to claim 5, wherein said second valve actuator comprises a diaphragm spread within a casing to form a working chamber connected to said first opening of said three-way solenoid valve, an operating rod having its one end fixed on said diaphragm and the other end drivingly connected to said second valve member, and a balance spring provided within said working chamber for urging said diaphragm in a direction to cause said second valve member to open said second branch of said intake passage.

7. An internal combustion engine according to claim 3, wherein said third valve means comprises a third valve member for opening and closing said EGR passage, a third pressure operated valve actuator connected to said first opening of said three-way solenoid valve, and said third valve actuator being responsive to atmospheric pressure for causing said third valve member to close said EGR passage and being responsive to vacuum for causing said third valve member to open said EGR passage.

8. An internal combustion engine according to claim 7, wherein said third valve actuator comprises a diaphragm spread within a casing to form a working chamber connected to said first opening of said three-way solenoid valve, an operating rod drivingly connecting said diaphragm to said third valve member, and a balance spring provided within said working chamber for urging said diaphragm in a direction to cause said third valve member to close said EGR passage.

* * * * *